United States Patent [19]

Davis, Jr. et al.

[11] Patent Number: 4,471,790

[45] Date of Patent: Sep. 18, 1984

[54] TOBACCO MASS TREATMENT METHOD

[75] Inventors: James M. Davis, Jr., Mechanicsville; Howard M. Wilkerson, Chester, both of Va.

[73] Assignee: Philip Morris Incorporated, New York, N.Y.

[21] Appl. No.: 366,434

[22] Filed: Apr. 7, 1982

[51] Int. Cl.[3] ..... A24B 3/12

[52] U.S. Cl. ..... 131/301; 131/302; 131/303

[58] Field of Search ..... 131/300, 301, 302, 303, 131/304, 306; 34/54

[56] References Cited

U.S. PATENT DOCUMENTS 3,931,825 1/1976 De Coursey ..... 131/301

4,053,991 10/1977 Steffen ..... 34/54

*Primary Examiner*—V. Millin

*Attorney, Agent, or Firm*—Arthur I. Palmer; D. Anthony Gregory; George M. J. Sarofeen

[57] ABSTRACT

A method for quickly conditioning a mass of tobacco uniformly throughout the mass with steam for the purpose of moisturizing and heating the tobacco evenly throughout.

A probe is provided to be inserted within the mass of tobacco for drawing a vacuum while steam is applied to the tobacco mass.

A temperature sensor is mounted on the probe to indicate the temperature of inner mass of tobacco.

Steam is applied until a desired temperature is sensed at the sensor. The application of steam is continued at that temperature for a period adequate to moisturize and sterilize the tobacco throughout.

28 Claims, 3 Drawing Figures

TOBACCO MASS TREATMENT METHOD

FIELD OF THE INVENTION

This invention relates to a method for quickly conditioning tobacco with steam uniformly throughout the mass for the purpose of heating and moisturizing the tobacco evenly and insuring that a high enough temperature is reached in the interior of a tobacco mass to kill all life. Tobacco which has been packed and stored in a curing environment in warehouses is stiff and dry to the extent that it becomes brittle and cannot be processed practically without breaking it up into fines. Introducing moisture into the tobacco makes it pliable and workable without unacceptable loss of product due to powdering.

DESCRIPTION OF THE PRIOR ART

Prior methods of conditioning tobacco have involved the use of probes which are driven into the bales or hogs-heads and steam is injected through the probe into the mass of tobacco for the purpose of distributing moisture therethrough. In another method, steam is introduced into the chamber and drawn through the tobacco mass to the probe which contains a vacuum. Another approach used is that of alternate steaming then applying a vacuum through the probe. These methods were preceded by the sweat-room method of moistening where tobacco was stored for a week to ten days in conditioned air at about 90° F. temperature with 90 percent relative humidity in the ambient air. This last particular method suffers from the disadvantage that a very large space is required in order to store the tobacco under sweat room conditions with the expense of conditioning the air and maintaining the moisture in this environment being very great.

Also, undesirably there is a gradient level of moisturization which results, in that the outer layers of tobacco become thoroughly saturated with moisture. From the outside inwardly moisture content becomes less and finally the center of the mass is seldom brought to a desired percentage of relative moisture content. Different areas of the mass of tobacco thus are found to contain a different moisture content from point to point throughout the mass of tobacco.

A more popular and more effective method of moisturizing a mass of tobacco is the high vacuum process. In this method tobacco is placed into a completely sealed structurally engineered vacuum chamber and the air is then evacuated from the chamber thereby drawing it out of the interstices within the mass of tobacco. When a sufficiently low absolute pressure is reached in the chamber a mixture of steam and water are introduced into the chamber. A penetration takes place which extends very deeply within the compressed tobacco adding warmth and moisture in what is desired will be a uniform manner, to the total mass enclosed in the chamber. In order to thoroughly and uniformly saturate and heat the tobacco throughout the mass to kill any life which may be present therein, the cycle, in prior art methods treatment, was repeated several times until the desired degree of moistening is obtained. After a leveling off of pressure, the chamber is vented to atmosphere and after an equilibrating period for allowing moisture to condense the vessel is opened and the tobacco is removed. This vacuum and pressurization method is considerably more capable of moistening and heating the mass of the tobacco relatively uniform throughout than is the sweat room method.

In another method the conditioning is carried out with the addition of steam exclusively. The steam is introduced following the evacuation cycle described above. In this method a steam supply is introduced into the evacuated chamber under a pressure of about 20 pounds per square inch. A probe which is inserted into the center of the tobacco mass draws air and steam radially inwardly to the center of the mass so that the supply of moisturizing steam travels from the outside of the mass inwardly to the center from the periphery. The method of withdrawing air and steam through a probe within the mass of tobacco has resulted in a great advantage in that better uniformity of heating, and better distribution of heat and moisture have been attainable than with former methods.

Such above former methods are described in U.S. Pat. Nos. 3,931,825; 3,124,142; and 3,131,700. These patents teach the basic method of introducing a probe through the center of the tobacco and drawing the steam inwardly toward openings in the probe. In such methods for moistening tobacco, a very important co-objective is to destroy any life in the tobacco by heating the mass to elevated temperatures. It has been found that temperatures high enough to kill all life can be attained by such methods of steaming, however, it has been observed that the centrally located areas within a bale or mass of tobacco may contain life intact and having the ability and to multiply after steaming. This was found to occur because the steaming action did not penetrate adequately to bring the central section to life killing temperatures. In order to penetrate the bale fully to the desired temperature at the center, an excessive steam temperature is used to create a high enough temperature level throughout the tobacco mass to guarantee a full kill. This has been found to be detrimental to the tobacco itself which became overheated at certain points throughout the mass. A non-deleterious method of heating is sought which will distribute moisture evenly throughout the mass while heating the tobacco throughout to a temperature high enough to destroy life throughout the mass and yet not reach a level of temperature at any point in the mass whereby the tobacco may be adversely affected.

In the attempt to thoroughly heat and saturate the total mass of tobacco uniformly in former methods they have resorted to reheating the same mass by reevacuating and reintroducing the steam more than one time excessively. The whole cycle was generally repeated at least once and possibly several times until the desired degree of uniform moistening and heating was thought to have been reached. Recent evidence indicates that the heat sensing techniques of former methods which included detecting temperature and moisture levels by means of temperature sensors positioned in the vessel on the outside of the mass of tobacco have been inadequate. The actual temperatures at the innermost core of the mass of tobacco treated was found not to coincide with the temperature readings. Consequently the temperatures reached within the center of the tobacco mass had been an estimate based upon readings taken with the temperature sensors positioned at points within the vessel but outside of the mass of tobacco itself.

It has, therefore, been postulated that a means be devised for gaging the temperature level at the core of the tobacco rather than at the periphery. So that steam may be more accurately applied to guarantee a proper core temperature.

SUMMARY OF THE INVENTION

In the present invention, the tobacco to be moistened is placed in a vacuum chamber and an evacuation probe is inserted into the mass of dried tobacco as practiced in the former methods described above; however, in accordance with the presently described mode of the invention, a temperature sensor is positioned within the probe itself to read the actual temperature which exists within the tobacco at any given time during the treatment cycle. Preferably the probe and chamber are connected by suitable valving to a system which is adapted to evacuate the chamber. Further to this, suitable piping and valving are provided to allow for the introduction of steam. In a cycle or cycles which are considered applicable in the practice of the best mode of the present invention, the chamber is evacuated to an absolute pressure below the flash point and desirably to a level of well below one inch Hg absolute, this is carried out to remove all or nearly all of the noncondensables and thus thoroughly prepare the tobacco for the introduction of steam. This evacuation step may be followed by steam admission to the periphery while evacuation is simultaneously taking place through the probe. This results in a flow of steam inwardly through the tobacco from the periphery to the probe at the center where evacuation negative pressure is encouraging travel of steam from the outside surfaces through the tobacco to the center of the mass. A gradual pressure build-up takes place from the exceedingly low starting absolute pressure to the maximum pressure desired. This is followed by a holding period at this temperature and pressure corresponding with predetermined maximums known to guarantee that total life kill is assured and desired moisturization has been achieved. After this initial holding period, the tobacco is once again evacuated and a second steaming operation, preferably at a temperature lower than the first steaming and holding period operation, is carried out to conclude the process.

In the practice of the present invention, the steaming period is carried out for a length of time necessary to insure that the temperature at the central core of the tobacco mass has reached a desired temperature at or near the level of the temperature at the periphery so that the life kill may be completed. The present mode of the invention provides a sensing device within the probe which is provided at least at the lower end thereof, to sense the level of temperature at the lower center, since this is the most difficult area to reach, and thereby to insure that the steaming cycle is not ended prior to the heating of those innermost central areas resulting in reaching the desired kill temperature level.

Accordingly the primary object of the present invention is to provide a method and apparatus for adequately sensing temperature levels within one or more critical areas in a mass of tobacco so that the total volume of the mass may be brought to a temperature and moisture level desired uniformly throughout the mass whereby a complete moisturization and life kill may be effected without overheating and damaging some of the tobacco in the mass.

A further object is to precondition tobacco by such a process in which all of the tobacco in a mass is conditioned uniformly to desired levels of life kill temperature and moisture content.

Other objects and advantages of the invention will be apparent from an inspection of the accompanying drawings and the subsequent description.

DESCRIPTION OF THE PREFERRED EMBODIMENTS

Figure 1:
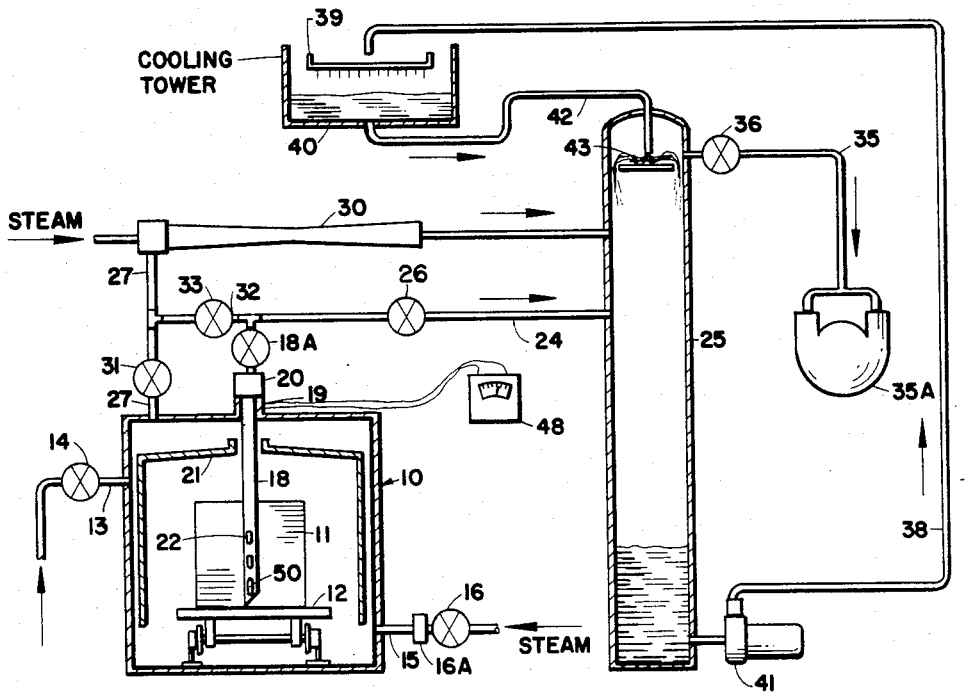
FIG. 1 is a schematic diagram of one embodiment of an apparatus suitable for practicing the present invention.

The invention is illustrated more or less diagramatically in the accompanying figures wherein referring first to FIG. 1, a vacuum chamber is indicated generally at 10. A quantity of tobacco which may, for example, be a hogshead of tobacco from which the cover has been removed and the side slats removed or loosened is indicated at 11 resting on a movable dolly conveyor or platform 12. For convenience, the platform may be suitably mounted on rails for ease in admitting, centering and removing the tobacco mass from the chamber. The capacity of the chamber may be varied within wide limits in that the chambers may be of a size sufficient to handle anywhere from a small batch of tobacco to 12 or more hogsheads.

An atmospheric venting outlet is indicated at 13 which outlet has a vacuum break valve 14, preferably of the butterfly type, therein. A chamber steam admission line at 15, the chamber steaming control value at 16 and a desuperheater at 16A cooperate to obtain saturation without superheat. It will be understood that a door which is hinged at one side or a door which may be vertically raised may be provided at one or both ends of the chamber for moving tobacco into and out of the chamber. The door is provided with appropriate seals which are vacuum tight, all of which is within the skill of the art at present.

An evacuation probe is indicated generally at 18. The probe passing through suitable vacuum tight sealing means indicated at 19 in the cover or top of the vacuum chamber. A suitable mechanism is provided for moving the probe between a retracted position in which it is elevated and out of contact with the tobacco in the chamber and an extended position in which it has been inserted into the central zone of a mass of tobacco as indicated at 20. The probe passes through a false ceiling 21 in the vacuum chamber the purpose of which is to intercept condensation which forms on the roof of the chamber and causes it to be deflected away from the tobacco being conditioned.

The probe includes a calculated number of orifices, which may be circular or elongated holes, indicated generally at 22, and is preferably of a length sufficient to extend completely to the bottom of the mass of tobacco in the extended position as shown. It will be noted that the probe terminates about one-half inch to one inch above the bottom of tobacco, and there are no probe holes present in the upper portion of the probe above the top of the mass of tobacco to be conditioned.

An exterior extension of the probe is connected to a probe suction value 18A and a first vacuum conduit 24, the conduit discharging into a condensor 25. A condensor isolating valve is indicated at 26 in the first vacuum conduit.

The second vacuum conduit is indicated at 27, said second vacuum conduit having its intake and opening directly into the chamber. Said second vacuum conduit connects to condensor 25 and a first stage steam vacuum ejector indicated generally at 30. A chamber isolating valve is indicated at 31.

A third vacuum conduit is indicated at 32, said third vacuum conduit having one end in communication with the first vacuum conduit 24 between the probe suction valve 18A and condenser isolating valve 26, and the other end opening into the second vacuum conduit 27 between the chamber isolation valve 31 and the first stage steam ejector 30. A probe isolation valve 33 is located in the third vacuum conduit.

The evacuation system further includes a second evacuation means which consists of a two stage liquid ring vacuum pump 35A having its intake opening into the condenser 25 through vacuum suction conduit 35 and an insolution valve 36.

The condensating system includes, in addition to the condenser, a discharge line 38 the inlet of which is beneath the water level in the condenser, and the outlet of which discharges into a suitable water dispersion mechanism 39 in cooling tower 40.

A suitable pump means is indicated at 41. Cooled water from cooling tower 40 is transferred by line 42 into the barometric condenser vessel where it is discharged against a splash plate 43 positioned in the fluid path between the openings of vacuum conduits 24 and 27 on the one hand, and the inlet to the two stage vacuum pump 35A on the other hand. Arrows in lines 38 and 42 indicate the direction of flow of the cooling fluid.

The end use operation of the above described system are as follows:

In operation, tobacco in a compressed condition and which is too dry and brittle for entering into the tobacco manufacturing process is placed on wheel dolly 12 and rolled into vacuum chamber 10, the probe 18 being retracted by mechanism 20 to permit entry of the tobacco. Once in position, the door is closed, the chamber sealed and the mechanism 20 operated to extend the probe 18 downwardly to the illustrated FIG. 1 position. The probe is located in the central zone, and preferably along the vertical central axis, of the mass of tobacco 11 to be moistened. Once the probe is in position in which it extends substantially the full vertical height of the mass of tobacco with all perforations 22 opening only into the mass of tobacco 11, the steam ejector system is operated to create a vacuum within the chamber and within the mass of tobacco. The cycle will become clear from a reference at this point to FIG. 3.

Figure 3:
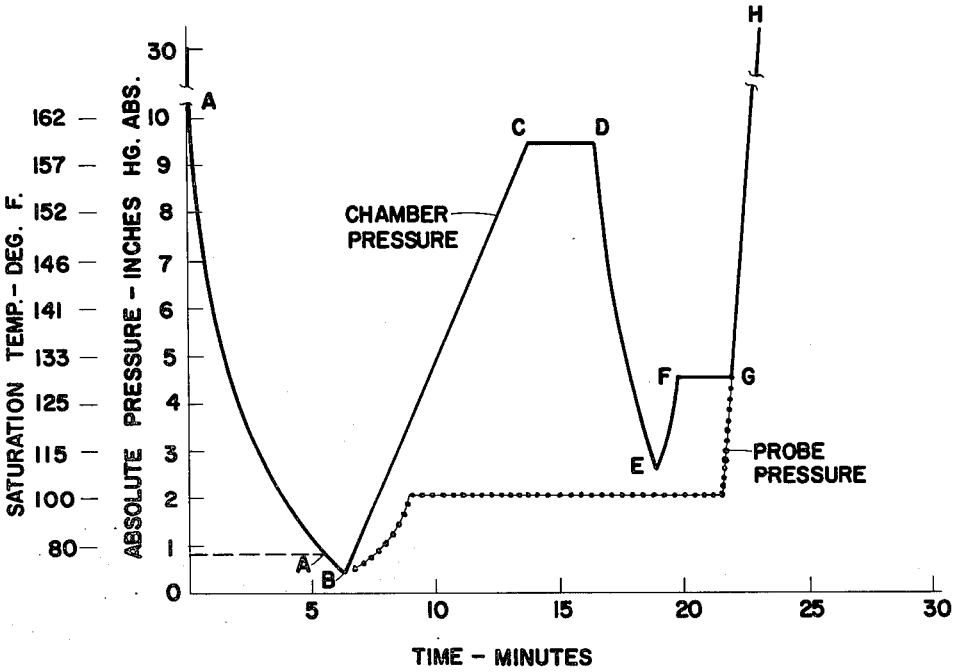
FIG. 3 is a cycling diagram illustrating a typical cycle of the present invention.

Referring now to FIG. 3, which is a typical cycle diagram described in terms of absolute pressure and corresponding saturation temperature along the vertical axis, and time along the horizontal axis, as the following operations occur.

INITIAL EVACUATION

At zero minutes evacuation of the chamber through vacuum conduits 24 and 27 by means of the two stage vacuum pump 35A begins.

In this condition, the vacuum break valve 14 and chamber steaming valve 16 are closed, the vacuum break valve remaining closed until the very end of the cycle. Chamber isolation valve 31, probe isolation valve 33, condensor isolation valve 26 and probe suction valve 18A are opened. Rapid evacuation of the chamber and the tobacco occurs, as will be noted from the steep slope of that portion of the curve which begins at point A and extends toward point B.

It will be understood that at point A the chamber temperature is ambient and the tobacco temperature may be any temperature within a range of, for example, 33° F. to 95° F. depending upon the temperature of the storage location of the tobacco prior to placement in vacuum chamber 10 for moistening.

It should also be understood that in a typical installation the two stage vacuum pump is effective down to an absolute pressure of about 1.4 inch Hg absolute to 0.4 inch Hg absolute and the first stage steam ejector may be effective in the range of from about 2.4 inches Hg absolute down to about 0.2 inch Hg absolute.

Accordingly, shortly before the upper effective limit of the two stage vacuum pump is reached and, concurrently, after the effective working range of the first stage ejector is reached, the first stage ejector is brought on stream. Thus, for example, the first stage jet 30 may be cut in when the absolute pressure in the chamber reaches about 2.4 inch Hg.

At the cut in point of the first stage jet 30 the condenser isolating valve 26 is closed.

FLASH POINT

At some point near the end of the first evacuation, step A-B, a condition will be attained in which the chamber temperature and the tobacco temperature are identical, which condition is hereafter referred to as the flash point. For purposes of illustration the flash point is indicated at point $A_1$ in FIG. 3 although it will be understood it may vary widely; indeed, it may occur at any point in the first evacuation period corresponding to a pressure of about 3/10ths to 1.5 inches Hg absolute.

PULL-DOWN POINT

Evacuation is continued to an absolute pressure in the range of about 0.2–0.3 inches Hg absolute, indicated at point B.

At this point all, or virtually all, of the noncondensibles have been removed from the chamber, and from within the individual tobacco leaves.

When this point is reached both the chamber and the tobacco temperature will be approximately the same, and may, for example, be in the range of from about 33° F. to 60° F.

INITIAL STEAMING

At this point the chamber isolation valve 31 and the probe isolation valve 33 is closed, and the condenser isolation valve 26 remains closed. The first stage jet 30 is shut down and the chamber steaming valve 16 is opened.

In this condition steam enters the chamber via line 15 and as the temperature increases to approximately 110° F. on 2.6 in. Hg the condenser isolation valve 26 is opened. The steam is pulled radially inwardly through the tobacco toward the probe. As the steam moves radially inwardly it enters the pores of the tobacco, from which non-condensables have been earlier removed, and moistens and heats the individual pieces of tobacco.

At this time, the probe vacuum is controlled by the vacuum pump suction flow through conduit 24, condenser 25, and the vacuum suction conduit 35 connected to vacuum pump 35A.

During this portion of the cycle, which may for example extend from about the 7 minute mark to the 10 minute mark, steam is being admitted through line 15 slightly faster than it can be condensed or evacuated through probe 18 with the result that the pressure and temperature both increase until point C is reached. Point C represents a pre-determined maximum temperature which may be, for example, in the range of about 152° F. to 160° F. At point C the chamber temperature will be at the pre-determined maximum, but the temperature of a least portions of the tobacco will be something less than the pre-determined maximum because of the temperature lag experienced during the conditioning process.

Figure 2:
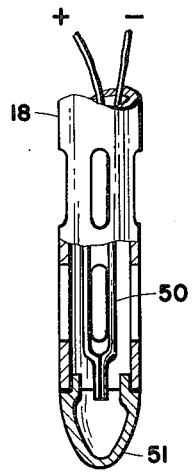
FIG. 2 is a cut-away view of the probe of FIG. 1.

It is in connection with this temperature lag that the mode of the present invention comes into play. A device for sensing the actual temperature at the lower center of the tobacco mass is positioned in the probe 18 with the temperature sensor 50 extended into the probe tip 51, FIG. 2 element. This device generates a signal which can be used to control probe suction valve 16 and consequently the temperature control point C, FIG. 2.

It may, for example, be desired to terminate the pressure rise portion of the first steaming step when the pressure is in the range of about 9–11 inches Hg absolute, but in any event less than about 160° F., which is the temperature above which the tobacco may be deleteriously affected. Or it may, for example, be sufficient to raise the temperature only to about 140° F. since experience has shown that good penetration of the tobacco occurs at this temperature and pressure and insect life is effectively killed. However, the individual operator may wish to carry the temperature higher, as for example to 152° F., which for many years was thought to be the minimum temperature necessary to ensure total insect kill.

It will also be understood that shortly after the lower effective operating limit of the second and third stage steam ejectors was reached during the pressure rise, the first stage ejector was shut down.

FIRST HOLDING

When point C is reached at about 10 minutes chamber steaming valve 16 is throttled so that a balance is established between steam admitted and steam removed by the vacuum system.

The length of the first holding period may be varied within several minutes. In the illustrated cycle a period of time of about 2 minutes is shown. Preferably the total time of the first and second holding periods is about 6 minutes, and accordingly the first holding period may be shortened or lengthened as desired, at least within this range.

The primary function of the first holding period is to ensure that all portions of the tobacco reach the desired temperature which, as mentioned above, may be in the range of about 152° F. to about 160° F.

It will be understood that during this first holding period the steam and any non-condensibles entering the chamber via line 15 will be continually pulled radially inwardly through the tobacco and unused steam or non-condensables discharged through evacuation probe 18.

RE-EVACUATION

At the end of the first holding period, that is, when point D in the cycle has been reached, the chamber steaming valve 16 is closed, the chamber isolation valve 31 is slowly opened, and the probe isolation valve 33 is opened while the chamber isolating valve 26 remains open.

As a result the pressure in the chamber and in the tobacco drops into the range of about 2.6–6.7 inches Hg absolute, which corresponds to a chamber temperature of about 110° F.–145° F.

Because of the higher specific gravity of the tobacco, however, the temperature of the tobacco will lag the temperature in the chamber; a typical range of temperature for the tobacco at this time may be 120° F.–136° F.

It is at this point in the cycle that a loosening action of the tobacco will occur. The loosening action is controlled by the re-evacuation rate and can be seen by visual observation through a porthole in the chamber. The volume of the mass of tobacco actually expands an inch or more in height and/or diameter.

FINAL STEAMING

At point E on the cycle chamber isolation valve 31 and probe isolation valve 33 are closed, chamber steaming valve 16 is opened, and steam is again admitted to the chamber.

Preferably the steam is admitted at a rate to bring the temperature up to about 130° F.–140° F. and about 4.5" Hg absolute pressure and then it is condensed and exhausted through the vacuum system at a rate, so the pressure remains substantially constant during the latter part of the second steaming step at about 4.5" Hg absolute. The condenser isolating valve 26 remains open so that creation of vacuum is adjusted under control of the second and third stage jets.

The length of the final steaming step E-G may be varied within limits. In the representative cycle a period of these minutes in the latter part of the scond steaming step has been shown, although, this may be increased or decreased. It is preferred, however, that the length of the two holding periods C-D and F-G total about 6 minutes.

In any event the holding period is long enough so that all the tobacco reaches the chamber temperature. In the illustrated example a chamber and tobacco temperature of 130° F., which corresponds to an absolute pressure of 4.5 inches Hg, has been illustrated.

BREAK-OUT AND CYCLE END

At the end of the final steaming step, point G, the chamber steaming valve 16 and the condenser isolating valve 26 are closed, chamber isolating valve 31 and probe isolation valve 33 remain closed, and vacuum break valve 14 is opened to admit atmospheric pressure to the interior of the chamber.

Preferably the break vacuum valve 14 is opened slowly so that pressure equalizes gradually inside and outside the tobacco.

At the end of the cycle the temperature in the chamber will of course rise to ambient and the pressure to approximately 29.92 inches Hg absolute. The temperature of the tobacco will remain at the last holding temperature, in this instance preferably about 135° F.±2°. At this temperature, however, it is suitable for further processing.

REMOVAL

The probe control mechanism 20 is then operated to retract probe 18 and the tobacco is removed from the chamber and transferred to the next processing station. The vacuum break valve 14 remains open, and the chamber is in condition to receive another load of tobacco to be processed.

At the conclusion of the process, which requires only about 23 minutes for a conventional sized hogshead, the tobacco has, in the past, been consdered to be in a heated, moistened condition with no cold spots.

However, thorough examination has shown that in certain areas of the tobacco interior life has been found to survive the steaming operation. Experiments conducted in an attempt to develop a fool proof program of heating to guarantee life kill at the most central area of the tobacco mass have not given uniform results. Life was found to be present in the central areas at least on an intermittent basis from bale to bale. It was found that according to the practice of the present invention that the provision of a heat sensor attached to the evacuation probe at end and introducing steam until a kill temperature of at least 150° F. was held over a holding period of two minutes resulted in sterile adequately moistened tobacco every time. A temperature indicator 48 which is connected by suitable means to the heat sensor 50 which may be a resistance thermometer with transmitter such as is manufactured by Burns Engineering Inc./-Fisher Controls Company as model No. WSPOGI/PM 513. The temperature indicator 48 may be an indicating controller such as model No. TL101 made by Fisher Controls Company.

The heat sensor element 50 is located in the probe tip 51 and is carried into the lower end of the tobacco mass when the probe 18 is inserted. In this position, it senses the temperature at a location which is likely to be the coolest spot in the tobacco mass. This is thought to be the case since the penetration of the mass by the steam is most likely first to become completed at the upper level due simply to the natural tendency for heat to concentrate first in upper portion of the enclosure and cooled air would naturally concentrate at the lower levels. The natural resistance to penetration by the mass of tobacco would slow the entering steam fairly uniformly throughout except for the fact that cooler pockets of steam created on condensation at the lower levels would likely reduce the rate of penetration to the central core in the same length of time which it might take to penetrate the upper levels. This non-uniformity of action may result in occasionally leave the central lower portion of tobacco not heated at a sufficiently high temperature for a long enough period to kill all life which may be present.

The method and apparatus of the present invention will positively not allow any variance from the desired result. The fact that the probe is equipped with the heat sensor element allows for positive sensing of the temperatures of that area of volume of tobacco which would represent the area likely to be at the lowest temperature. Simply applying steam long enough at a killing temperature as sensed in the vicinity of the heat sensor as observed on the controller would guarantee a desirable heating level for a desired period of time.

A killing heat cycle would be accomplished within the range of 140° F. to 150° F. for a holding period of from two to three minutes of time.

In practice the method of the invention is carried out by implementing the heating and processing steps above described with the additional care to be certain to observe that the necessary temperature is reached at the sensor location and is held at that temperature for the lengths of time desired.

For further amplification of the temperatures and pressures which may exist in the system during a typical cycle, refer to the following table.

TEMPERATURE/PRESSURE CONDITION TABLE

| Step | Point In Cycle | Temperature, °F. Chamber | Temperature, °F. Tobacco | Pressure in. Hg. abs. |
|---|---|---|---|---|
| Initial Evacuation | A | Ambient | 33°-95° | 30 |
| Flash Point | $A_1$ | 33°-95 ° | 33°-95° | .3-1.5 |
| Initial Steaming | B | 33° | 33°-85° | .2 |
| First Holding | C | 160° | Less than 160° | 10.0 |
| Re-Evacuation | D | 160° | 152°-160° | 10.0 |
| Final Steaming | E | 110°-116° | 120°-136° | 3.4-5.3 |
| Second Holding | F | 135° | 130°-140° | 4.5 |
| Break-Out | G | 135° | 135°± 2° | 4.5 |
| Cycle End | H | Ambient | 135°± 2° | 30 |

One of the desirable attributes of the method of this invention is that after non-condensibles are almost totally removed from the tobacco leaf throughout the entire mass prior to initial admission of steam and upon the admission of steam, proper penetration into the individual tobacco leaves during the initial steaming throughout the mass is verified by the temperature sensor 50. Experience has shown that full penetration of the steam into the tobacco mass during steaming is substantially superior to penetration in other processes, and this uniformity and ease of penetration is believed to be attributable, to the ability to verify that the innermost core of the tobacco mass has been properly steam treated. It will be understood, of course, that a proper amount of steam is admitted to the tobacco leaves since the method of the present invention assures that steam penetration at desired temperature reaches every part of the mass.

Further, the steaming is especially efficient because a maximum driving force has been provided for adding steam to the individual tobacco leaves. That is, the absolute pressure is in the neighborhood of 0.3-0.5 inches Hg absolute at the start of the initial steaming step, and the pressure may rise to as high as 9-10 inches Hg absolute. This should be contrasted with other cycles, such as the Vacuum Flow cycle in which the pressure differential may only be on the order of about 4 inches Hg absolute.

VALVE DIAGRAM

| Step | Point In Cycle | Chamber Steaming Valve 16 | Chamber Isolation Valve 31 | Probe Isolation Valve 33 | Probe Suction Valve 18A | Condensor Isolation Valve 26 | Break Vacuum Valve 14 |
|---|---|---|---|---|---|---|---|
| Initial Evacuation | A | C | O | O | O | O | C |
| Flash Point | $A_1$ | C | O | O | O | C | C |
| Pull Down Point | B | O | C | C | O | C | C |
| Initial Steaming | B | O | C | C | O | O @ 2"Hg | C |
| First Holding | C | O (throttling) | C | C | O/C | O | C |
| Re-evacuation | D | C | O | O | O | O | C |

-continued

VALVE DIAGRAM

| Step | Point In Cycle | Chamber Steaming Valve 16 | Chamber Isolation Valve 31 | Probe Isolation Valve 33 | Probe Suction Valve 18A | Condensor Isolation Valve 26 | Break Vacuum Valve 14 |
|---|---|---|---|---|---|---|---|
| | | | (controlled) | | | | |
| Final Steaming | E | O | C | C | O/C | O | C |
| Second Holding | F | O | C | C | O/C | O | C |
| | | (throttling) | | | | | |
| Break-Out | G | C | C | C | O | C | O |
| Cycle End | H | C | C | C | O | C | O |

C - Closed
O - Open
C/O - Open or Closed, controlled by the heat sensor device to obtain the beetle bill temperature The following table entitled "Cycle Steps" is provided in order to be referred to for better understanding of the multiple steps of the heating and pressurizations hereinabove described.

| CYCLE STEPS | |
|---|---|
| Initial Evacuation | A to B |
| Initial Steaming | B to C |
| First Holding | C to D |
| Re-Evacuation | D to E |
| Final Steaming | E to F |
| Second Holding | F to G |
| Venting | G to H |

It will at once be apparent to those skilled in the art that other modifications may be made within the spirit and scope of the invention. Accordingly, it is intended that the scope of the invention be limited not by the scope of the foregoing description, but solely by the scope of the hereafter appended claims when interpreted in light of the pertinent prior art.

We claim:

1. A method of heating a mass of tobacco for moisture conditioning comprising the steps of:

a. applying a moist heated gaseous medium to said mass of tobacco;

b. Sensing the temperature at a location within the mass of tobacco;

c. Maintaining the application of said moist heated gaseous medium to said mass of tobacco until the temperature sensed at said location within the mass of tobacco reaches a desired level.

2. The method of claim 1, wherein said gaseous mdium is maintained at a temperature level high enough to sterilize said mass of tobacco.

3. The method of claim 1, wherein the said gaseous medium is steam.

4. The method of claim 3 wherein the application of said steam is maintained for a length of time necessary to bring said mass of tobacco to a desired level of moisture content.

5. The method of claim 3, wherein the application of said steam is maintained for a period of time to sterilize said mass of tobacco.

6. A method of sterilizing a mass of tobacco comprising the steps of:

a. inserting a perforated probe having a temperature sensing device mounted thereon into a mass of tobacco;

b. applying a moist heated gas to the mass of said tobacco;

c. sensing the temperature in the vicinity of said probe in said mass of tobacco;

d. maintaining said application of said moist heated gas until a desired sterilizing temperature is sensed in the vicinity of said probe.

7. A method of moistening tobacco comprising the steps of:

a. introducing a perforated probe having a temperature sensing device mounted thereon into a mass of tobacco;

b. drawing a vacuum on said probe for evacuating noncondensibles from said mass;

c. applying heated moist gas to said mass of tobacco;

d. sensing the temperature at a position inside said mass of tobacco;

e. maintaining the application of said moist gas to said mass of tobacco until a desired level of temperature is reached at said temperature sensing position within said mass of tobacco.

8. A method of conditioning tobacco comprising the steps of:

a. inserting a perforated probe having a temperature sensing device mounted thereon into said mass of tobacco;

b. establishing a negative pressure at said probe;

c. withdrawing noncondensibles from said mass of tobacco through said probe;

d. applying steam to said mass of tobacco;

e. sensing the temperature of said mass of tobacco at a position within said mass in the vicinity of said probe;

f. maintaining the application of steam to said mass of tobacco until a desired temperature is reached in the vicinity of said probe.

9. In a process of moistening a body of tobacco which may contain life comprising the step of:

a. inserting a perforated probe having a temperature sensing device mounted thereon into the body of tobacco in substantially the central area thereof and positioning said probe within said body;

b. placing the probe bearing body of tobacco into an enclosed chamber, said chamber being constructed to facilitate the creation and maintenance of subatmospheric pressure therein;

c. evacuating said chamber within which the body of tobacco is placed to a subatmospheric pressure to remove substantially all air from said chamber;

d. introducing steam into said enclosed chamber while simultaneously evacuating said chamber through said perforated probe, and continuing said steaming with evacuation through said probe simultaneously to thereby move substantially pure steam through said body of tobacco for a period of time until the body of tobacco is substantially uniformly treated to a predetermined moisture level;

e. the improvement comprising sensing the temperature in the vicinity of said probe and, maintaining said steaming until said temperature reaches a desired level.

10. In a process of sterilizing a body of tobacco which may contain life comprising the steps of:

a. inserting a perforated probe having a temperature sensing device mounted thereon into the body of tobacco in substantially the central area thereof and positioning said probe within said body such that it extends therein a substantial depth thereof;

b. housing the probe bearing body of tobacco in an enclosed chamber, said chamber being constructed to facilitate the creation and maintenance of subatmospheric pressure therein;

c. evacuating said chamber through a first evacuating means to a subatmospheric pressure to remove substantially all air from said chamber;

d. isolating said evacuated chamber from said first evacuating means when said subatmospheric pressure and air removal is realized in the chamber;

e. introducing steam into said enclosed evacuated chamber while simultaneously evacuating said chamber through said perforated probe, and continuing said steaming and evacuation through said probe simultaneously to thereby move substantially pure steam through said body of tobacco until the body of tobacco is substantially uniformly treated to a predetermined moisture level, sensing the temperature in the vicinity of the probe to determine that it is at a sterilizing temperature.

11. In a method of moistening compressed tobacco the steps of:

a. subjecting compressed tobacco containing substantial quantities of non-condensibles to an absolute pressure below the flash point of the non-condensibles;

b. thereafter, and commencing at a time when said tobacco is subjected to a first low absolute pressure, passing steam generally radially inwardly only through the tobacco throughout substantially the entire height of the tobacco and simultaneously withdrawing unused steam and non-condensibles from the central zone of said tobacco;

c. controlling the steam flow to the tobacco in such fashion that the temperature of the tobacco does not exceed a predetermined maximum, the tobacco being maintained at a substantially constant pressure for a period of time at the end portion of the aforesaid controlled steam flow, d. sensing the temperature at an inner zone of said compressed tobacco until said temperature reaches a desired level before terminating the steam flow, e. terminating the steam flow after the sensed temperature in the entire mass of tobacco has attained the predetermined desired temperature and an absolute pressure of the system has increased to a desired level substantially corresponding to said temperature but below atmospheric;

f. lowering the absolute pressure from the pressure existing while the mass of tobacco was subjected to the predetermined maximum temperature to an absolute pressure above the initial low absolute pressure;

g. subjecting the tobacco at the last mentioned pressure to steam which is passed generally radially inwardly only through the tobacco throughout substantially the entire height thereof and simultaneously withdrawing unused steam and noncondensibles from the central zone of said tobacco;

h. maintaining the tobacco at a substantially constant pressure for a period of time near the end portion of the last mentioned subjection to steam, and, upon conclusion of the subjection of the tobacco to the last mentioned steaming;

i. raising the pressure to which the interior and exterior of the mass of tobacco is subjected to atmospheric pressure.

12. The method of moistening tobacco of claim 11 further characterized in that:

a. the absolute pressure to which the tobacco is initially subjected is in the range of about 0.2 inch Hg absolute.

13. The method of claim 12 further characterized in that:

a. the predetermined maximum temperature to which the tobacco is subjected following subjection to the initial low absolute pressure below the flash point is in the range of about 152° F. to 160° F.

14. The method of claim 13, further characterized in that:

the temperature to which the tobacco is subjected during the last steaming is in the range of about 130° F. to 140° F.

15. The method of claim 14 further characterized in that:

a. the total time at which the tobacco is subjected to steam treatment at substantially constant pressures following the initial and subsequent evacuation is approximately 3 minutes.

16. In a method of moistening tobacco the steps of inserting an evacuation probe having a temperature sensing device mounted thereon into the vertical central zone of a mass of tobacco to be moistened in a gas-tight chamber, a. evacuating the interior of the tobacco through the probe, and the chamber until a first vacuum level is reached which is below the flash point of the non-condensibles in the tobacco;

b. thereafter admitting steam into the chamber while simultaneously drawing a vacuum on the probe to cause said steam to pass radially inwardly only towards the probe and out of the system;

c. sensing the temperature in said tobacco at one or more points within the mass thereof;

d. continuing the simultaneous admission of steam to the chamber and evacuation through the probe until a pressure in the chamber is attained which corresponds to a sensed temperature in the tobacco range of about 152° F. to 160° F.;

e. holding the tobacco at substantially constant pressure in the presence of steam in the aforesaid range until substantially the entire mass is at a sensed temperature in the aforesaid range in the vicinity of the inner zones of the mass of tobacco until those zones have reached a desired predetermined maximum temperature for a desired period before terminating the steam flow, f. re-evacuating the interior of the tobacco through the probe, and the chamber, until a vacuum level is reached corresponding to a chamber temperature of about 110° F. to 116° F., said vacuum level being a higher absolute vacuum than the aforesaid first vacuum level, g. introducing steam and holding the tobacco at substantially constant pressure in the presence of said steam admitted into the chamber only in the aforesaid range while continuing to evacuate through the probe, and, upon conclusion of subjection of the tobacco to the last mentioned steaming treatment.

17. The method of moistening tobacco of claim 16 further characterized in that:

the absolute pressure to which the tobacco is initially subjected is in the range of about 0.2 inch Hg.

18. The method of moistening tobacco of claim 17 further characterized in that:

the temperature to which the tobacco is subjected during the second period of low absolute pressure treatment is in the range of about 110° F. to about 116° F.

19. The method of moistening tobacco of claim 18 further characterized in that:

the total time to which the tobacco is subjected to steam treatment at substantially constant pressures following the initial and subsequent evacuations is approximately 3 minutes.

20. An apparatus for moistening a mass of tobacco comprising:

a. a pressure vessel for receiving said tobacco;

b. a perforated probe within said mass of tobacco for withdrawing noncondensibles from said tobacco; and c. a temperature sensing device mounted on said probe adapted to be inserted in said mass of tobacco for sensing the temperature within said mass of tobacco.

21. The apparatus of claim 20 wherein said probe is connected to evacuator means for evacuating said noncondensibles from said mass of tobacco.

22. The apparatus of claim 21 wherein said evacuator means is a steam evacuator.

23. The apparatus of claim 22 further comprising means for introducing steam into said pressure chamber.

24. The apparatus of claim 23 wherein said means for introducing steam into said pressure chamber is adapted to introduce steam into said chamber at a point apart from said probe.

25. The apparatus of claim 24 further comprising means associated with said pressure vessel whereby said pressure vessel may be evacuated to a negative pressure, to ambient pressure, or to a positive pressure.

26. In the apparatus of claim 25, means connecting said probe to the low pressure side of said steam evacuator.

27. The apparatus of claim 26 further comprising:

a. means including a first valve to supply steam to said steam evacuator;

b. means including a second valve to supply steam to said means for introducing steam into said pressure vessel;

c. means including a third valve connected to said discharge side of said steam evacuator to return a portion of the spent steam from said ejector to said pressure vessel.

28. The apparatus of claim 27, further comprising:

a. control means including a pressure responsive device in said pressure vessel, said control means arranged to work cooperatively with said temperature sensing device to signal said control means to initially open said first valve, to open said second valve after the pressure in said pressure vessel has been reduced to below 10 inches of mercury, absolute, to open said third valve after the temperature in said tobacco mass as sensed by said temperature sensor has reached substantially a predetermined valve, and thereafter to position said second value to maintain substantially a given temperature in said mass of tobacco.

* * * * *

UNITED STATES PATENT AND TRADEMARK OFFICE

CERTIFICATE OF CORRECTION

PATENT NO. : 4,471,790

DATED : September 18, 1984

INVENTOR(S) : James M. Davis, Jr. et al

It is certified that error appears in the above-identified patent and that said Letters Patent is hereby corrected as shown below:

Column 11, line 49, change "mdium" to --medium--.

Column 16, line 35, change "valve, and thereafter to position said second value" to --value, and thereafter to position said second valve--.

Add claim 29 as follows:

29. In an apparatus for moistening tobacco having a pressure vessel for receiving said tobacco, and a perforated probe for insertion within said mass of tobacco for withdrawing noncondensibles from said tobacco; the improvement comprising a temperature sensing device and means for mounting said temperature sensing device on said probe.

On the title page, "28 Claims" should read -- 29 Claims --.

Signed and Sealed this

*Fifth* Day of *March 1985*

[SEAL]

*Attest:*

DONALD J. QUIGG

*Attesting Officer* *Acting Commissioner of Patents and Trademarks*